United States Patent [19]

Zielinski et al.

[11] 4,248,020

[45] Feb. 3, 1981

[54] PRECAST CONCRETE

[75] Inventors: Zenon A. Zielinski; Czeslawa Zielinski, both of Montreal, Canada

[73] Assignee: Canadian Patents & Development Ltd., Ottawa, Canada

[21] Appl. No.: 46,470

[22] Filed: Jun. 7, 1979

[30] Foreign Application Priority Data

Jul. 31, 1978 [CA] Canada ..... 308414

[51] Int. Cl.[3] ..... E04F 11/14

[52] U.S. Cl. ..... 52/185; 52/79.1; 52/189

[58] Field of Search ..... 52/79.1, 184, 185, 189

[56] References Cited

U.S. PATENT DOCUMENTS

| | | | |
|---|---|---|---|
| 3,755,974 | 9/1973 | Berman | 52/185 X |
| 3,788,018 | 1/1974 | Simmons et al. | 52/185 |
| 3,830,026 | 8/1974 | Tylius | 52/185 |

FOREIGN PATENT DOCUMENTS

| | | | |
|---|---|---|---|
| 1138751 | 2/1957 | France | 52/185 |
| 197711 | 11/1977 | Sweden | 52/185 |
| 440354 | 12/1935 | United Kingdom | 52/185 |

*Primary Examiner*—J. Karl Bell

*Attorney, Agent, or Firm*—Francis W. Lemon

[57] ABSTRACT

A precast concrete stairway module comprising a concrete wall assembly which is C-shaped in plan view, providing a side wall and two end walls, a concrete stair flight extending from an edge of one side wall to a mid-height position of the other side wall. The stair flight assembly is moulded integrally with the wall assembly and comprises a landing at each end and a flight of stairs therebetween. An access opening is provided in the wall assembly.

4 Claims, 7 Drawing Figures

PRECAST CONCRETE STAIRWAY MODULE

Figure 1:
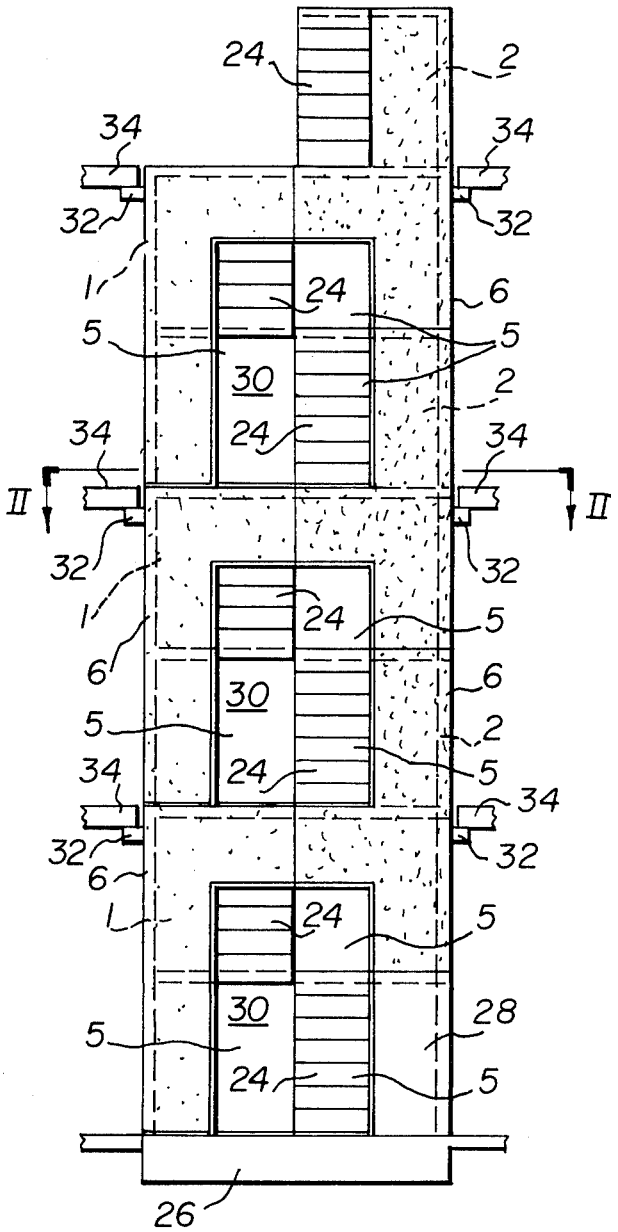

This invention relates to a precast concrete stairway module. Existing building codes require that every high rise building such as, for example, an apartment or public building is provided with at least two stairways which can be used as fire exits. These stairways are required to be fire resistant with a required fire resistance rating of one or two hours as the case may be.

Concrete is known for its good fire resistance and so many of the stairways are constructed from concrete or reinforced concrete. The stairway itself is a rather complicated structural element in buildings. Construction of stairways in concrete technology is quite difficult and expensive. Most concrete stairways are built using concrete blocks by casting reinforced concrete on site as the basic structural material. The use of the above mentioned structural materials makes the construction of stairways slow and time consuming. In many cases, the stairways cannot be built at the same time as the building is being erected. In such cases, temporary stairs (or ladders) have to be erected in order to allow movement of construction labour, which are replaced later by permanent stairways. This practice adds to the cost of the building construction.

Attempts have been made to introduce prefabricated stairways in order to eliminate the above mentioned disadvantages. Several prefabricated stairway systems are being used. For example, separate prefabricated steps and landing platforms are used which are made from reinforced concrete or steel. The plurality of prefabricated separate elements used in such systems makes the construction of stairways still expensive and difficult because of the plurality of the connections and high accuracy required in mating parts.

There still exists a need to provide a system which substantially overcomes all the above mentioned disadvantages.

There is also a need to provide a construction module which combines many elements of a stairway including walls, steps and landing platforms into a single unit.

It would also be desirable to provide precast concrete modules which are self supporting where walls, landing platforms and steps are connected into a single unit which is easy to produce, to transport and erect.

According to the present invention, there is provided a precast concrete stairway module, comprising (a) a concrete wall assembly having an access opening and which is C-shaped in plan view to provide a side wall and two end wall portions, and (b) a concrete stair flight assembly within the wall assembly and extending from a marginal edge portion of a first one of the end wall portions, along an inner side of the side wall, to a mid-height portion of a second one of the end wall portions, the stair flight assembly being moulded integrally with the wall assembly and comprising a landing at each end with a flight of stairs extending therebetween.

The present invention provides precast stairway modules which are placed in the position and interconnected by, for example, welding, bolts or post tensioning cables placed at selected points of an interface plate, to create a rigid tube-like structural system with extremely high strength for normal, vertical load and with additional strength to support horizontal forces due to wind or earthquake. The latter feature facilitates the use of the stairways to provide lateral stability to the building during the erection and useful life of the building.

The precast stairway modules of the present invention may be erected before the construction of the building and are immediately useful after the erection thereof.

The precast stairway modules of the present invention can be located inside a building, as is the case with most conventional buildings, or they can provide free standing stairway-wells, located outside of the building such as, for example, with buildings of the gallery type. The precast stairway modules of the present invention can be used for the construction of additional stairways to existing buildings.

It is a feature of the present invention that a fire resistant stairway is provided by the precast stairway modules which can be used as a fire exit, because the required fire resistance can be provided to any required fire rating by simply providing walls of corresponding thickness.

The precast stairway modules can be equipped with projecting brackets to support adjoining floors which can be made in any material such as, for example, timber, concrete prefabricated slabs. Modules can also be equipped with projecting cantilevering slabs which are a part of adjoining floors.

Openings in walls of the precast stairway modules can be provided for doors and windows in places as may be required in a particular architectural design.

In the present invention, only one basic type of module is made in a single mold or identical molds which makes prefabrication simple and inexpensive. Separate modules may differ from each other by a different size and the locations of openings and in some cases by a different arrangement of the projecting floor slabs or brackets. These differences are obtainable in the same precasting mold or similar ones by providing the or each mold with supplementary inserts and forming units.

In general, the present invention provides a system which uses a single mold produced module allowing a construction of high rise stairways of any height in number of floors able to support gravity loads from stairway and adjoining floors if required and to provide lateral resistance to the building resulting from the fact that the stairways, when erected and when the elements are properly interconnected, behaves like a rigid monolithic tube-like structure. The important feature of this system is the simplicity in erection, full stability at every erection stage and the elimination of the necessity for using any temporary bracing or supporting for lateral stability. The modules can be erected by simply placing them side by side, one on top of another one, without any additional connections therebetween.

Figure 2:
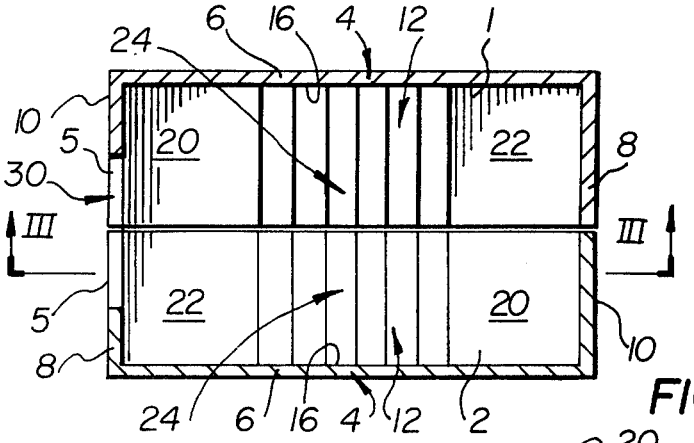
Figure 3:
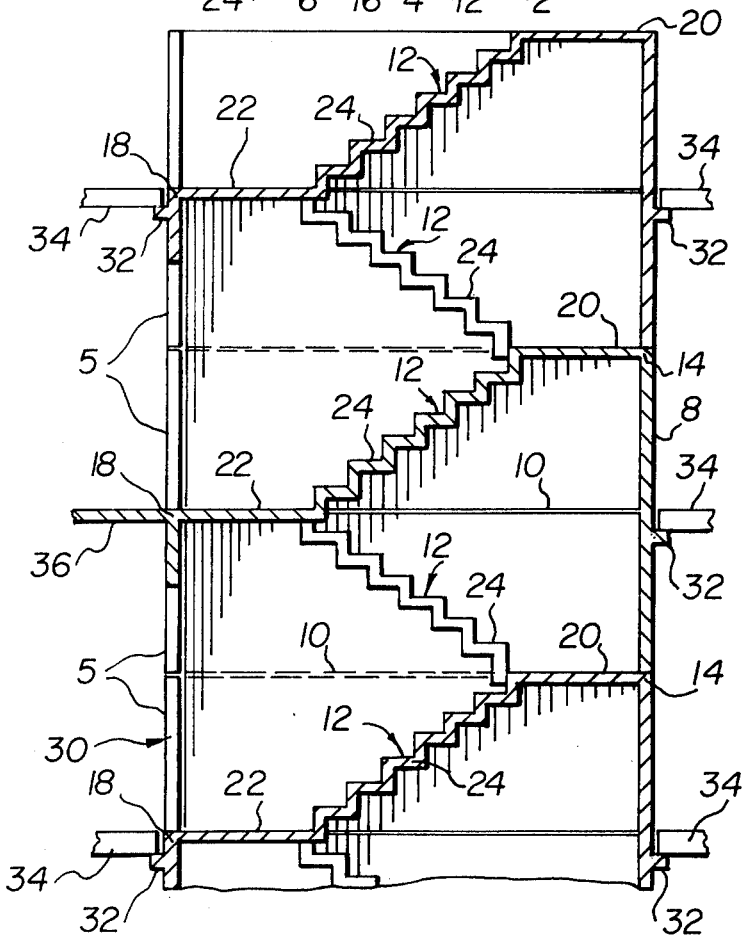
Figure 4:
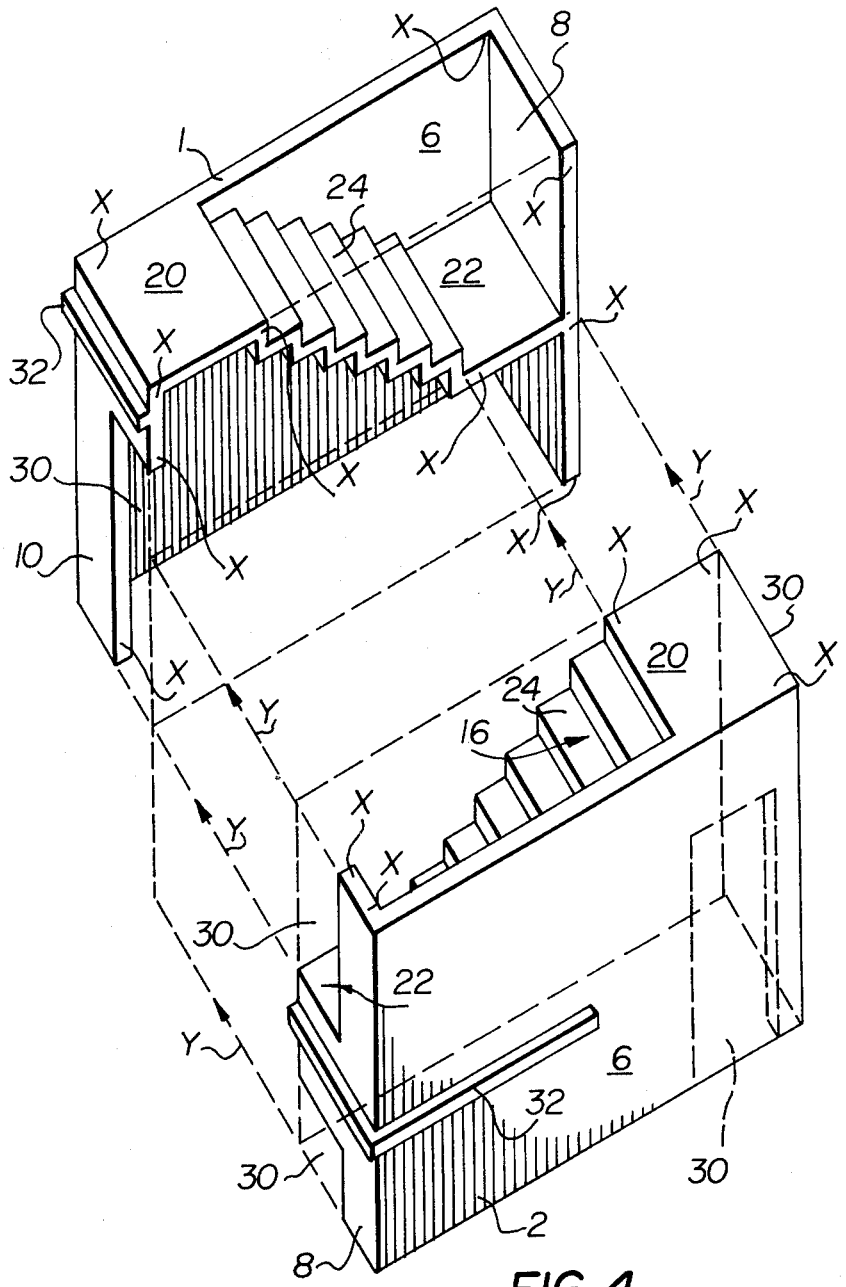
Figure 5:
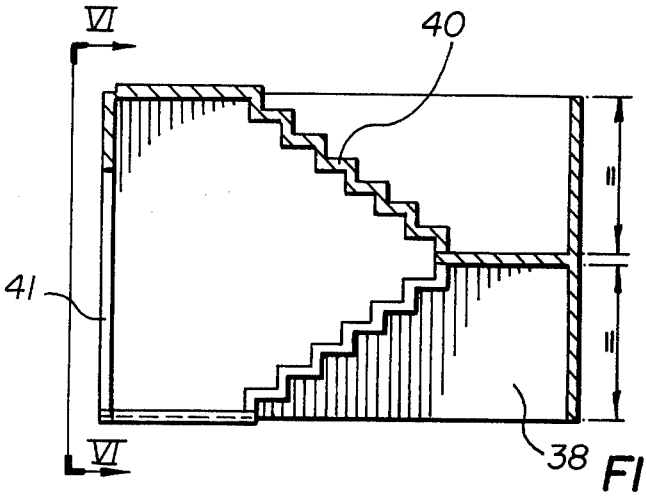
Figure 6:
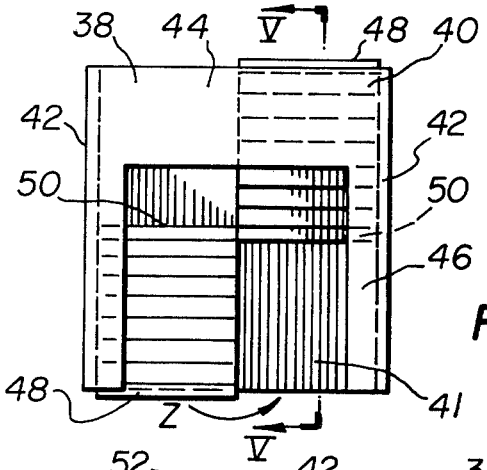
Figure 7:
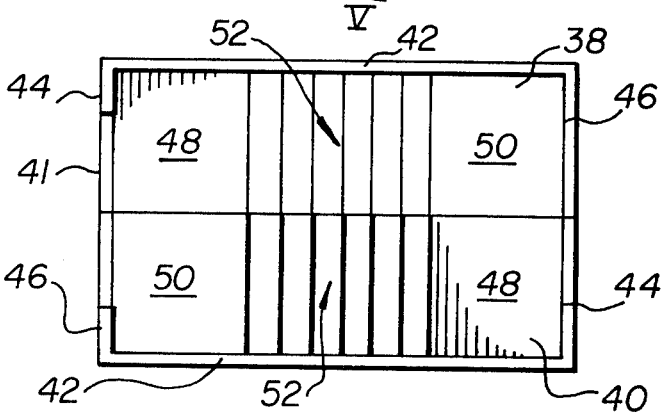

In the accompanying drawings which illustrate, by way of example, embodiments of the present invention, FIG. 1 is an end view of a stairway assembled from a plurality of precast concrete stairway modules, FIG. 2 is a sectional plan view along II—II, FIG. 1, FIG. 3 is a sectional side view along III—III, FIG. 2, of an upwardly extending portion of the stairway, FIG. 4 is an exploded corner view of two of the stairway modules shown in FIGS. 1 to 3, FIG. 5 is a sectional side view along V—V, FIG. 6, of two more or less identical precast concrete stairway modules which are different to those shown in FIGS. 1 to 4, FIG. 6 is an end view along VI—VI, FIG. 5, and FIG. 7 is a plan view of FIG. 5.

In FIGS. 1 to 3, there is shown a stairway comprising a plurality of precast concrete stairway modules, generally designated 1 and 2. Each prefabricated stairway module 1 and 2 comprising:

(a) a concrete wall assembly 4 having an access opening 5 which is C-shaped in plan view to provide a side wall 6 and two end wall portions 8 and 10, and (b) a concrete stair flight assembly 12 within the wall assembly 4 and extending from a marginal edge portion 14 of a first one, designated 8, of the end wall portions, along an inner side 16 of the side wall 6, to a mid-height portion 18 of a second one, designated 10, of the end wall portions, the stair flight assembly 12 being moulded integrally with the wall assembly 4 and comprising a landing 20 or 22 at each and a flight of stairs 24 extending therebetween.

In this embodiment, the bottom left hand module 1 is placed on a foundation slab 26 which is designed in accordance with the loads which the stairway is expected to carry and the soil conditions. A special bottom right hand module 28, which is equivalent to the landings 20 and 22, stairs 24 and the portions of the side wall 6 and end walls 8 and 10 contained between the levels of the landings 20 and 22, is placed on the foundation slab 26 against the bottom left hand module 1. The special bottom right hand module 28 is positioned on the foundation slab 26 turned through 180°, about a vertical axis, relative to the bottom left hand module 1 to form therewith a bottom portion of a stairway. The bottom left hand module 1 and the special bottom right hand module 28 are secured and sealed together and to the foundation slab 26 in a conventional manner. The assembly of the stairway is then proceeded with by placing a right hand module 2 on the special bottom right hand module 28 and securing and sealing the right hand module 2 to the special bottom right hand module 28 and to the bottom left hand module 1. A second left hand module 1 is then placed on the bottom left hand module 1 and is secured and sealed to the bottom left hand module 1 and to the right hand module 2. The assembly of the stairway is then continued in this manner by placing each additional right hand module 1 on the right hand module side followed by each additional left hand module 2 on the left hand module side until the stairway is completed.

Doorways, such as doorways 30 comprising the access openings 5 and/or windows (not shown) are cast into the walls, 6, 8 and/or 10 by providing removable cores in the moulds for the modules 1, 2 and 29. It should be noted that the removable cores required for access openings 5 providing portions of each doorway 30 in the left hand modules 1 are different from those required for the portions of each doorway 30 in the right hand modules 2 and the special bottom right hand module 28.

In this embodiment, each stair flight assembly 12 spans downwardly from the marginal edge portion 14 of the first one of the end wall portions 5.

As previously stated the landings 20 and 22 and/or the stairs 24 are moulded integrally with the side walls 6 and the end walls 8 and 10.

External support brackets 32 on the wall assembly 4 may be cast integrally with the modules 1 and 2 for supporting adjacent floors 34. In different embodiments, adjoining floors, such as floors 36, are moulded integrally with the modules 1 and 2.

In FIG. 4, similar parts to those shown in FIGS. 1 to 3 are designated by the same reference numerals and the previous description is relied upon to describe them.

It can be seen from FIG. 4 that the modules 1 and 2 are basically geometrically similar except for the portions of doorways 30, and the positions of support brackets 32, which can be provided in a mould by removable inserts so that a plurality of similar moulds can be used for the production of all of the modules 1 and 2. The dashed lines and the arrows Y show how both of the modules 1 and 2 are positioned against one another to form portions of the stairway.

For the purposes of the required sound insulation and fire resistance it will be necessary to make joints between the modules 1 and 2 which are solid and air tight. This can be achieved by filling in all of the joints with grout, cement, mortar or an epoxy resin. The structural integrity of a stairway, which works as a monolithic tube, can be achieved by providing special structural connections. Different means of connection are possible including bolting, post tensioning or welding of steel plates against embedded steel inserts. Suitable structural points for placement of bolted or welded connections are designated X in FIG. 4. The number, the capacity and location of structural connections has to be determined for each individual project by calculation. However, in cases where the staircase is not used as structural elements providing horizontal resistance and structural stability to the building, no special structural connections are required, except for filling in of joints. The most convenient way of production of modules is by arranging the moulds in such a way that the modules 1 and 2 are cast horizontally with the side walls 6 at the top of the mould and the steps 16 and the landings 20 and 22 cast vertically.

In FIGS. 5 to 7, there are shown two stairway modules 38 and 40 which are identical, except for the position of the doorway 41, which can be used to construct a stairway without a special bottom module such as module 28 in FIG. 1.

The modules 38 and 40 each comprise a side wall 42, end wall portions 44 and 46, landings 48 and 50 and stairs 52.

In this embodiment, the module 38 is first placed in position and then the module 40 oriented in an upside down position in the direction of arrow Z (FIG. 6), from the orientation of the module 38, is placed in position next to the module 38. A number of modules 39 and 40 can be stacked in this manner to provide a stairway.

It will be appreciated that in this embodiment the landings 48 and 50 are designed to support a load on either side, i.e., whichever side is uppermost when the module is in use. Further, the landings 48 preferably protrude one half of their thickness beyond the side wall 42 and end walls 44 and 46 to avoid a step between two adjacent landings 48 and 50 and to provide a locating means between the lowest modules and the foundation slab and between adjacent modules in the vertical direction.

We claim:

1. A precast concrete stairway module, comprising:

(a) a concrete wall assembly having an access opening and which is C-shaped in plan view to provide a side wall and two end wall portions, and (b) a concrete stair flight assembly within the wall assembly and extending from a marginal edge portion of a first one of the end wall portions, along an inner side of the side wall, to a mid-height portion of a second one of the end wall portions, the stair flight assembly being moulded integrally with the wall assembly and comprising a landing at each end with a flight of stairs extending therebetween.

2. A module according to claim 1, wherein the stair flight assembly spans downwardly from the marginal edge portion of the first one of the end wall portions.

3. A module according to claim 1, which includes external brackets on the wall assembly for supporting adjacent floors.

4. A module according to claim 1, which includes an adjoining floor integral with wall assembly.

* * * * *